US011067371B2

(12) United States Patent
Choiniere et al.

(10) Patent No.: US 11,067,371 B2
(45) Date of Patent: Jul. 20, 2021

(54) TRIMMABLE TAIL KIT RUDDER

(71) Applicant: BAE SYSTEMS Information and Electronic Systems Integration Inc., Nashua, NH (US)

(72) Inventors: Michael J. Choiniere, Merrimack, NH (US); Jason T. Stockwell, Brookline, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 259 days.

(21) Appl. No.: 16/361,322

(22) Filed: Mar. 22, 2019

(65) Prior Publication Data

US 2020/0300590 A1 Sep. 24, 2020

(51) Int. Cl.

| | |
|---|---|
| ***F42B 10/60*** | (2006.01) |
| ***F42B 10/20*** | (2006.01) |
| ***F42B 10/26*** | (2006.01) |
| ***F42B 10/62*** | (2006.01) |

(52) U.S. Cl.

CPC ..... *F42B 10/20* (2013.01); *F42B 10/26* (2013.01); *F42B 10/60* (2013.01); *F42B 10/62* (2013.01)

(58) Field of Classification Search

CPC ..... B64C 13/00; F42B 10/00; F42B 10/20; F42B 10/26; F42B 10/54; F42B 10/60; F42B 10/62; F42B 10/14; F42B 10/64

USPC ..... 244/21, 22, 3.1, 3.11, 3.13, 3.22, 3.23, 244/3.24, 3.27

See application file for complete search history.

(56) References Cited

U.S. PATENT DOCUMENTS

| | | | | |
|---|---|---|---|---|
| 3,968,945 A * | 7/1976 | Walton | F42B 10/14 | 244/3.28 |
| 4,512,537 A * | 4/1985 | Sebestyen | F41G 7/222 | 244/3.21 |
| 4,624,424 A * | 11/1986 | Pinson | F42B 10/64 | 102/384 |

(Continued)

FOREIGN PATENT DOCUMENTS

| | | | |
|---|---|---|---|
| DE | 102008007435 A1 * | 8/2009 | F42B 10/26 |
| FR | 2860577 A1 * | 4/2005 | F42B 10/14 |

OTHER PUBLICATIONS

Maher, Amanda. Strong carbon fiber artificial muscles can lift 12,600 times their own weight. University of Illinois at Urbana-Champaign [online], Apr. 17, 2018 [retrieved on Mar. 11, 2021]. Retrieved from the Internet: < URL: https://phys.org/news/2018-04-strong-carbon-fiber-artificial-muscles.html#jCp>.

*Primary Examiner* — Richard R. Green
*Assistant Examiner* — Michael A. Fabula
(74) *Attorney, Agent, or Firm* — KPIP Law, PLLC; Scott J. Asmus

(57) ABSTRACT

A tail kit assembly of a guided munition having a tail kit base connected to a trailing end of a projectile body. The tail kit base is rotatable relative to the projectile body. A trimmable rudder has forward and rearward ends. The forward end is pivotally coupled to the tail kit base, such that the trimmable rudder can, relative to the tail kit base, between retracted and extended orientations. An actuator is fixed between the tail kit base and the rearward end of the trimmable rudder. The actuator is electrically coupled to an onboard guidance system that controls actuation of the actuator to pivot the trimmable rudder between the retracted orientation and the extended orientation.

19 Claims, 4 Drawing Sheets

(56) References Cited

U.S. PATENT DOCUMENTS 4,699,333 A * 10/1987 Pinson ..... F42B 10/64 244/3.21
4,869,442 A * 9/1989 Miller ..... F42B 10/14 244/3.28
6,109,852 A * 8/2000 Shahinpoor ..... B25J 9/1075 414/1
6,422,507 B1 * 7/2002 Lipeles ..... F41G 7/305 102/501
6,474,593 B1 * 11/2002 Lipeles ..... F42B 10/62 102/501
6,502,785 B1 * 1/2003 Teter ..... F42B 10/64 244/3.22
6,672,536 B2 * 1/2004 Bar ..... F42B 10/50 244/3.23
7,163,176 B1 * 1/2007 Geswender ..... F42B 10/64 102/400
7,325,769 B1 * 2/2008 Harnisch ..... F42B 10/64 244/3.27
7,354,017 B2 * 4/2008 Morris ..... F42B 10/54 244/3.23
7,728,265 B1 * 6/2010 Deeds ..... F42B 10/64 244/3.21
7,791,007 B2 9/2010 Harnoy
7,837,144 B2 * 11/2010 Kothera ..... B64C 27/615 244/99.2
8,049,149 B2 11/2011 GesWender et al.
8,410,412 B2 4/2013 Geswender et al.
8,816,260 B2 8/2014 Hindman et al.
8,916,810 B2 12/2014 Geswender et al.
9,303,964 B2 4/2016 Wurzel et al.
9,464,876 B2 * 10/2016 Morris ..... F42B 10/60
9,470,491 B1 * 10/2016 Ginetto ..... F42B 10/14
9,702,673 B1 * 7/2017 Ginetto ..... F42B 10/20
10,520,291 B1 12/2019 Vasudevan et al.
10,533,831 B1 * 1/2020 Choiniere ..... F42C 13/02
2003/0041768 A1 * 3/2003 Rastegar ..... F42B 12/46 102/517
2003/0178527 A1 * 9/2003 Eisentraut ..... F42B 10/14 244/3.28
2005/0116113 A1 * 6/2005 Lawless ..... B64C 5/12 244/201
2006/0065775 A1 * 3/2006 Smith ..... F42B 10/54 244/3.23
2008/0035798 A1 * 2/2008 Kothera ..... B64C 27/615 244/212
2008/0061188 A1 * 3/2008 Morris ..... F42B 10/60 244/3.23
2010/0213307 A1 * 8/2010 Hinsdale ..... F42B 10/54 244/3.23
2015/0345909 A1 * 12/2015 Morris ..... F41G 7/2293 244/3.11
2019/0152586 A1 * 5/2019 Stefes ..... B64C 23/06
2019/0152587 A1 * 5/2019 Stefes ..... B64C 9/34

* cited by examiner

TRIMMABLE TAIL KIT RUDDER

FIELD OF THE DISCLOSURE

The present disclosure relates to a tail kit assembly for a guided munition and more particularly to a tail kit assembly for a guided munition having a system of low profile trimmable rudders for guiding the munition along a trajectory.

BACKGROUND OF THE DISCLOSURE

Many guided munitions are known to include systems and/or assemblies that function to guide and control the munition by making corrections to its trajectory. These guidance systems typically include subsystems that can communicate with a fire control system which can implement course corrections—up or down and left and right maneuvers to alter or rather correct the course of the munition while in flight. Based on determinations made by guidance algorithms at the fire control system and communicated to the munition, different mechanical components of the munition can be activated or adjusted so as to control the flight path of the munition. These components are often generically referred to as "control surfaces" and can include wings, fins, strakes and rudders that, during flight, interact with the airstream to change the aeronautical characteristics and flight path of the munition.

Gun-fired, medium caliber munitions known in the art are constructed to have a general overall profile that provides a low degree of air resistance and facilitates rotation of the munition. A typical munition defines a longitudinal axis and may be formed with a conical leading end having a pointed or rounded tip, a central body section that is at least partially cylindrical, and a trailing end that may slope or taper radially inwardly from the central body section rearward.

The trailing end of the gun-fired munition may include a tail kit assembly coupled thereto that communicates with a guidance system as described above. Known tail kit assemblies can comprise a base coupled to the trailing end of the munition. In some cases, strakes and rudders are fixed to and extend outwardly from the surface of the base to stabilize the munition when in flight. When a guidance system is utilized in a gun-fired munition, controlling the trajectory of the munition is often problematic because the tail kit assembly needs to de-roll using strakes and place the rudder in the direction of the course correction. Gun-fired munitions can spin at a rotational rate of about 20,000 rpm causing the attached tail kit assembly to rotate, thus making calculation of its rotational orientation, which is essential for effectively guiding the munition, quite difficult and processor intensive.

To overcome this drawback, in some instances the base of the tail kit assembly is substantially rotationally decoupled from the munition such that the munition can spin at one rate of rotation due to the rifling of the barrel while the base spins at another slower rate of rotation. The strakes that are fixed to such a tail kit assembly can be angled or curved relative to the longitudinal axis, which generally corresponds to the direction of flight, so as to generate a rotational force on the base that is counter to rotation of the munition. To "de-spin" the base or, rather, to reduce or eliminate rotation of the tail kit assembly using the strakes simplifies determining the rotational orientation of the assembly and facilitates controlling the trajectory of the munition by way of the fixed rudder.

Conventionally, rudders and strakes are fixed to the surface of the base of the tail kit assembly and function to reduce the rotation of the assembly and guide or control the trajectory of the munition. When the munition is fired, shot, or launched from the ordinance the strakes and rudder project into the airstream as the munition travels along its direction of flight F or, in other words, the air resistance of the strakes and rudder produce counter rotation and transverse forces on the tail end of the munition in a desired manner thereby guiding or controlling the flight of the munition through the air. As is known in such aerodynamic components, the leading ends of the strakes and rudders are flush with the surface of the tail assembly base and progressively project further into the airstream along the axial length of the tail assembly. Due to the high rates of rotation, e.g., about 20,000 RPM of small munitions (25-30 mm) it is necessary for strakes to have a high or rather large profile such that their interaction with the airflow is significant enough in order to sufficiently counter the high rotational rates of the munitions enabling determination of the rotational position of the munition. Typical strakes of small munitions have a profile that is matched to the flight profile velocity, and coupled with the strakes projected area generate dynamic pressure to de-roll the tail kit. The size and shape of the strakes needs to be sufficient to overcome the bearing friction between the front of the munition and the base of the tail kit assembly. In addition, if the positioning of the tail kit is required to aide control guidance, the dynamics of the control actuator surface with the inertia of the tail kit needs to be considered in the sizing of the strakes. Since the typical control feature is a singular drag feature acting as a rudder in the air stream, roll placement of the rudder relative to the direction of travel is crucial for effectively controlling the trajectory of the munition. This results in aggressive strakes having a large surface area which interacts with the airstream to generate the needed control dynamics, thereby generating a significant amount of drag. Although the strakes and rudders as described above are beneficial for their intended purposes, because their fixed geometry on the outer surface of the base, the turning and drag forces caused thereby are constant. Such drag forces have a substantial negative effect on the velocity of the round and leads to a significant reduction in the effective range of such a guided munition. For example, it is common for a typical 30 mm×173 mm round to have a muzzle velocity of approximately Mach 3 (1,029 msec) and has a maximum range of about 5 km, but when a tail kit assembly, as described above, is utilized on the same round, because of the drag forces introduced thereby, the maximum range of the round decreases to about 3.5 km. While known tail kit assemblies facilitate guidance of such a round, the approximately 30% drop in the effective range of the round is undesirable.

Wherefore it is an object of the present disclosure to overcome the above-mentioned shortcomings and drawbacks associated with the conventional tail kit assemblies of guided munitions and more specifically with the tail kit assemblies of gun-fired, medium caliber guided munitions.

SUMMARY OF THE DISCLOSURE

One aspect of the disclosure is a tail kit assembly of a guided munition having a tail kit base that is connected, relative to a direction of flight, to a trailing end of a projectile body. The tail kit base can rotate about a longitudinal axis relative to the projectile body. At least one trimmable control surface, rudder, flap or tab has, relative to the direction of flight, forward and rearward ends. The forward end is coupled to the tail kit base, such that the at least one trimmable control surface, rudder, flap or tab can be biased, moved, flexed or pivoted relative to the tail kit base, between a retracted orientation and an extended orientation. The at least one actuator is fixed between the tail kit base and the rearward end of the at least one trimmable control surface, rudder, flap or tab and can be electrically coupled to an onboard guidance system. The onboard guidance system can control actuation of the at least one actuator so as to bias, move, flex or pivot the trimmable control surface, rudder, flap or tab between the retracted orientation and the extended orientation.

One further aspect of the present disclosure is a system comprising a tail kit assembly equipped with multiple, trimmable control surfaces, rudders, flaps or tabs that allow the strakes of the tail kit assembly, which reduce spin from 20,000 RPM to between 0 to 12,000 RPM, to be far less aggressive than strakes of known tail kit assemblies thereby substantially reducing the overall drag on the projectile. The trimmable control surfaces, rudders, flaps or tabs can be modulated up to 50 to 200 Hz depending on the actuator used for modulating the trimmable control surfaces, rudders, flaps or tabs. Modulation of the trimmable control surfaces, rudders, flaps or tabs allows the tail kit base to continue to rotate in the original rotational direction of the projectile body. For example, a typical 30 mm projectile leaves the muzzle of a cannon rotating at 20,000 RPM or 333 Hz. The trimmable control surfaces, rudders, flaps or tabs feature of the current disclosure can be actuated from zero to full rudder by the actuator which is modulated up to 50 to 200 Hz, such that de-spinning the tail kit base requires only 133 Hz of strake compensation. This allows the strake dynamic pressure to be reduced by approximately 3:1 (reduced bearing friction) relative to the dynamic pressure of known strakes. Further reduction is realized by removing the dynamic coupling of the control dynamics and active positioning of the tail kit in the direction of the correction. While the tail kit is spinning, independent modulation of four control surfaces, rudders, flaps or tabs at 200 Hz can be activated when at least one specific control surface is pointed, i.e., oriented in the direction of the needed course correction, thereby removing the need to control the positioning of the tail kit directly by means of strakes. This reduces drag even further and additionally increases the range of the projectile and overall mission effectiveness.

In one embodiment of the system the trimmable rudder can comprise one, two, three or four control surfaces, rudders, flaps or tabs. Each of the control surfaces, rudders, flaps or tabs provides variable course correction when in the course correction direction while the tail kit base spins. The course correction or the measure of the course correction is variable and is based on a current airspeed of the munition.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

Figure 1:
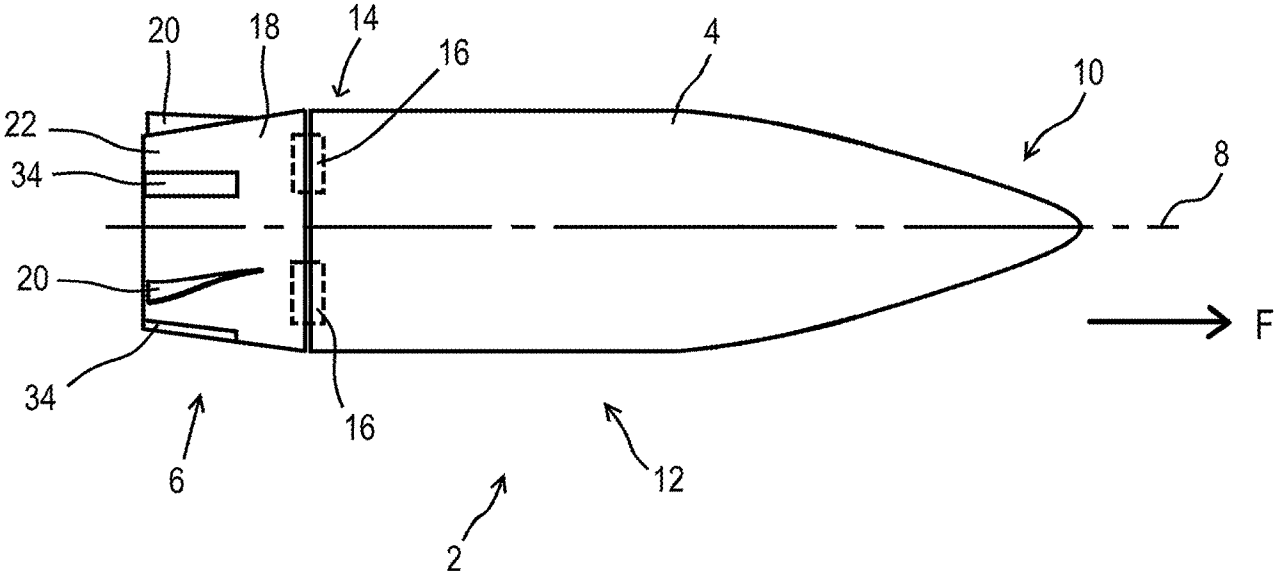
FIG. 1 is a side view of one embodiment of a guided munition having a tail kit assembly with trimmable rudders according to the disclosure.

FIG. 1 illustrates one embodiment of a gun fired munition according to the present disclosure. As used herein a munition should be understood as being a projectile, bullet, load, round or asset that is fired, shot, or launched from ordnance having a fire control system. The munition described in more detail below may have a small or medium caliber, ranging from 25 mm to 57 mm, or more specifically the munition has a caliber of 30 mm. When fired, the munition passes through a rifled barrel which causes the munition to rotate as it is discharged from the muzzle. Due to the rifling of the barrel small munitions of the type described herein have a rotational rate of 20,000 RPM.

Still referring to FIG. 1, the munition 2 has, with respect to a direction of flight F, a leading front body 4 and a trailing tail kit assembly 6 that together define a longitudinal axis 8. The front body 4 has a head end or ogive 10 and a central section 12 that is generally cylindrical in shape. Attached to a trailing end 14 of the front body 4 is the tail kit assembly 6 which is described in more detail below. The longitudinal axis 8 of the munition 2 generally corresponds to the instant direction of flight F of the munition 2.

The tail kit assembly 6 functions to direct, control or guide the munition 2 as it travels along a trajectory towards an intended target. The tail kit assembly 6 can be joined to the trailing end 14 of the front body 4 by way of bearings 16, e.g., ball, needle, or roller bearings in such a manner that a tail kit base 18 of the tail kit assembly 6 is rotationally decoupled from the front body 4. Because of this coupling, when the munition 2 is fired, shot, or launched out of a barrel, the front body 4 can spin about the longitudinal axis 8 at one rotational rate, e.g., 20,000 RPM while the tail kit base 18 can spin at different rotational rate or may not spin at all. The difference between the rotational speeds of the front body 4 and the tail kit base 18 is referred to below as the differential rotation speed. It is to be appreciated that the differential rotation speed can depend on a number of factors such as for example, the barrel rifling; the coupling between the front body 4 and the tail kit base 18; and the profile, i.e., form, size, and alignment of strakes 20 attached to an outer surface 22 of the tail kit base 18.

Figure 3:
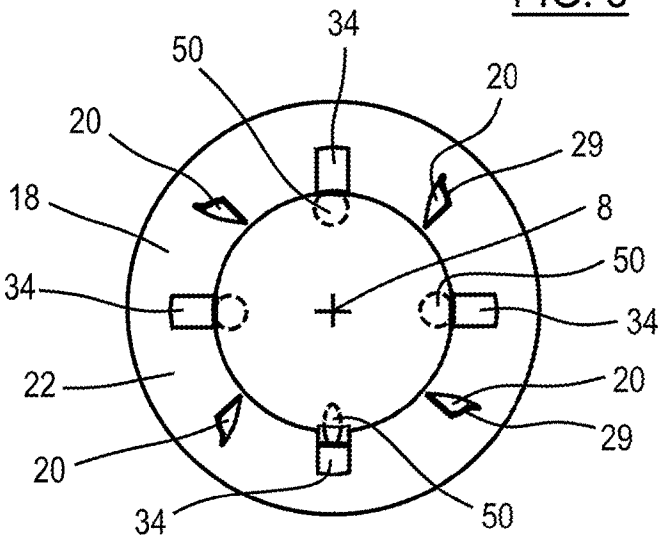
FIG. 3 is a trailing end view of the tail kit assembly according to FIG. 1.
Figure 4:
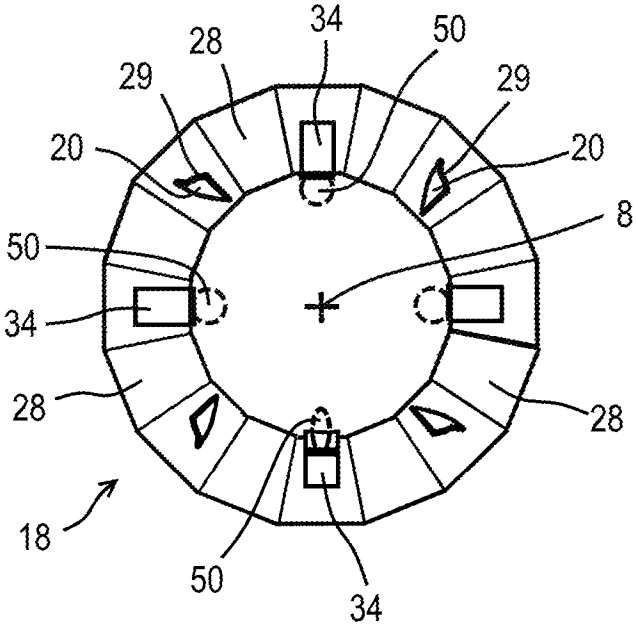
FIG. 4 is a trailing end view of another embodiment of the tail kit assembly according to the disclosure.

In certain embodiments of the present disclosure, the tail kit base 18 has, with respect to the direction of flight F, leading and trailing ends 24, 26. The outer surface 22 of the tail kit base 18 tapers inwardly along the longitudinal axis 8 from the leading end 24 to the trailing end 26. Although the general shape of the tail kit base 18 is a conical frustum, it is to be appreciated that the tail kit base 18 can have other profiles such as that of a cylinder or a prismatic cone for example. That is to say, from an axial point of view the outer surface 22 of the tail kit base 18 can have profile that is circular, as shown in FIG. 3, or even polygonal if the tail kit base 18 is formed by a plurality of axially extending planar surfaces 28 that are connected side to side about longitudinal axis 8 as shown in FIG. 4. In either case, the outer surface 22 at the leading end 24 of the tail kit base 18 is at least substantially flush with the trailing end 14 of the front body 4 and has a diameter that is greater than the diameter of the trailing end 26 of the tail kit base 18.

A number of control surfaces, hereinafter referred to as strakes 20, are secured to the outer surface 22 about the circumference of the tail kit base 18. The tail kit assembly 6 preferably has two to six strakes 20 and more preferably the tail kit assembly 6 has four strakes 20 as shown in FIG. 3. These strakes 20 can be rigidly fixed in position on the outer surface 22 of the tail kit base 18 in the manner of a helix as shown in FIGS. 1 and 3. It is to be recognized in this case, that the strakes 20 do not extend radially outward from the tail kit base 18 beyond a radial envelope of the munition 2. That is to say, the greatest radial dimension of the strakes 20 from the longitudinal axis 8 is no greater than the radial dimension of the central portion 12 of the front body 4 which generally corresponds to the caliber of the munition 2. This ensures that strakes 20 do not contact an inner surface of the barrel as the munition 2 passes therethrough, thus preserving the alignment and integrity of the strakes 20.

Figure 5:
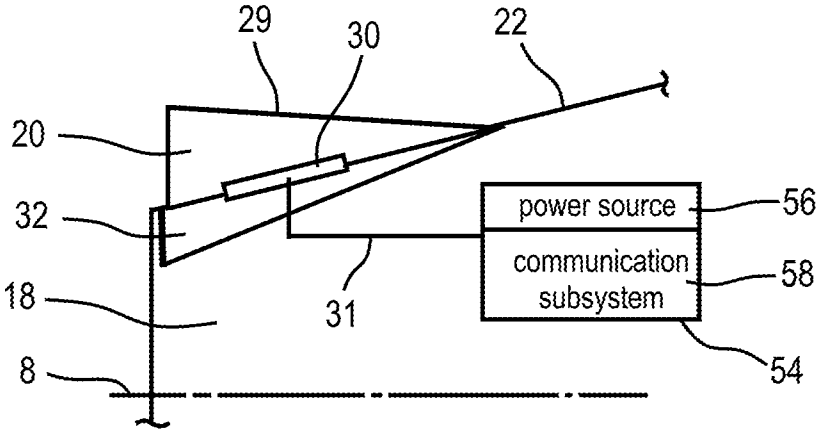
FIG. 5 is a side view of a portion of the trailing end of the tail kit assembly according to FIG. 1.

In certain embodiments, it is also possible for the strakes 20 to be secured to the tail kit base 18 in such manner that they can be arranged in a stowed position, when the munition 2 is secured within a casing and passes through the barrel, and can move to a deployed position when the munition 2 exits the muzzle of the barrel. It is also possible for a profile of the strakes 20 to be adjustable thereby enabling control the influence of the strake 20 on the rotation of the tail kit base 18, i.e., the differential rotational speed. For example, as shown in FIG. 5 the strakes 20 can be coupled to the tail kit base 18 by an actuator member 30 that applies a force on the strake 20 to variably bias an edge of the strake that is shaped in a helical manner 29 into the airstream. The actuator member 30 is electrically connected via an electrical lead 31 to an onboard guidance control system 54 which can adjust the voltage applied to the strake 20 such that the edge of the strake that is shaped in a helical manner 29 can have a greater or lower interaction with the airstream. In this manner, it is possible to adjust the differential rotational speed of the tail kit base 18 as a function of the munition 2 airspeed to thereby maintain a fixed differential rotational speed during flight. The actuator member 30 also facilitates moving the strakes 20 from the stowed position, in which they are arranged within recesses 32 in the outer surface 22 around the tail kit base 18. Once the munition 2 exits the muzzle, the actuator member 30 is activated to bias the strakes 20 into the deployed position. In another embodiment, the strakes 20 can be planar, curved and/or angled relative to the longitudinal axis 8 depending on the effects or aerodynamic characteristics desired of the strakes 20. In the deployed position, the edge of the strake that is shaped in a helical manner 29 extends into the airstream along the munition 2 to rotationally deflect the tail kit base 18 relative to the front body 4. As the rotational speed of munitions can be extremely high, known strakes are designed and arranged on tail kit assemblies to have a large profile or rather interface with the airstream so as to aggressively counter rotation of the projectile body. In addition, upon being deployed, known strakes become fixed relative to the tail kit assembly, meaning their aerodynamic characteristics cannot be changed. In comparison, the strakes 20 of the tail kit assembly 6 according to the disclosure have a reduced/smaller profile, as described below, and are adjustable so as to vary the aerodynamic characteristics thereof.

Figure 2:
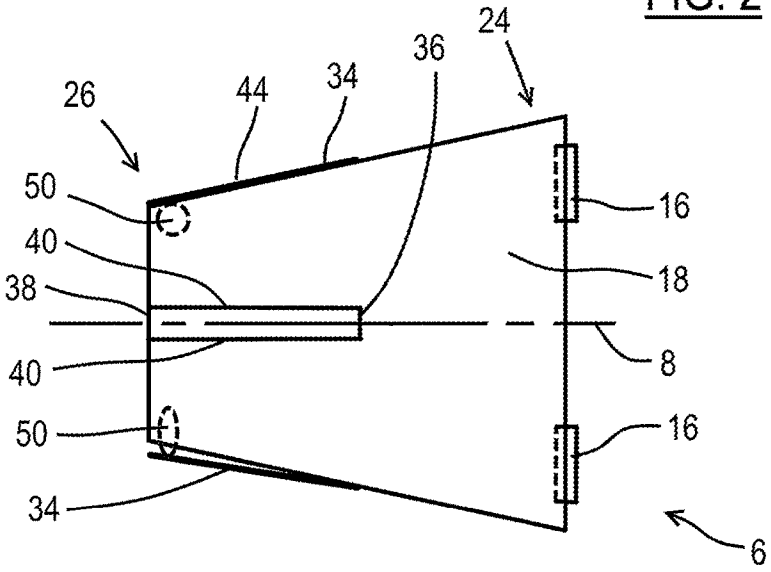
FIG. 2 is a side view of the tail kit assembly of the guided munition according to FIG. 1.

The tail kit assembly 6, according to the disclosure, includes one or more trimmable control surfaces, rudders, flaps or tabs 34, each of which has forward and rearward ends 36, 38 and side edges 40. Hereinafter the one or more control surfaces, rudders, flaps or tabs will be referred to as trimmable rudders. With regard to FIG. 2 it is to be recognized that the drawing of the tail kit assembly 6 does not illustrate the strakes 20 attached thereto for the purpose of clarity. Although only three trimmable rudders 34 are shown on the tail kit assembly 6 in FIG. 2, it is to be understood that the tail kit assembly 6 according to the present disclosure can include a single trimmable rudder 34 or a plurality of trimmable rudders 34. The tail kit assembly 6 preferably has two to six trimmable rudders 34 and more preferably the tail kit assembly 6 has four trimmable rudders 34 as shown in FIG. 3.

The embodiment of the tail kit assembly 6 shown in FIG. 3 has four trimmable rudders 34 and four strakes 20. In this case, the trimmable rudders 34 and the strakes 20 are distributed at equal intervals around its circumference. The trimmable rudders 34 can be individually actuated between a retracted orientation as shown in the upper portion of FIG. 2, and an extended orientation as shown in the lower portion of FIG. 2. In the retracted orientation (see FIGS. 6A and 7A), the trimmable rudder 34 is at least partially received within a pocket 42 in the outer surface 22 of the tail kit base 18. Preferably, when retracted, the trimmable rudder 34 is fully received within a pocket 42. In the extended orientation (see FIGS. 6B and 7B), the rearward end 38 of the trimmable rudder 34 is biased away from the tail kit base 18 such that the exterior surface 44 of the trimmable rudder 34 extends into the airstream. The interaction of the trimmable rudder 34 with the airstream produces a transverse force on the tail end of the munition 2 in a desired manner thereby laterally deflecting the tail kit assembly 6 and altering the direction of flight F of the munition 2. From a lateral point of view of the tail kit assembly 6 (see FIG. 2), the forward and rearward ends 36, 38 and two side edges 40 are aligned relative to each other such that the trimmable rudder 34 has a perimeter that is generally rectangular in shape. However; it is to be appreciated that the number and alignment of ends and edges of the trimmable rudder can be different such that the perimeter of the trimmable rudder 34 can have other shapes. The trimmable rudder 34 can have a profile with flat features or can be curved conformal to the tail kit base 18, e.g., the profile can be curved or planar depending on the shape and profile of the outer surface 22 of the tail kit base 18. Preferably the shape and profile of the exterior surface 44 of the trimmable rudder 34 matches the shape and profile of the outer surface 22 of the tail kit base 18 such that when the trimmable rudder 34 is in the retracted orientation, it is fully received within the pocket 42 and the exterior surface 44 of the trimmable rudder 34 conforms to the shape of the outer surface 22 of the tail kit base 18. In this manner, when not in use the retracted trimmable rudder 34 will have no effect on the aerodynamics of the tail kit assembly 6, i.e., in the retracted orientation, the trimmable rudder 34 does not cause any drag or disturbance of the airflow along the outer surface 22 of the tail kit base 18. The axial length of the trimmable rudders 34 from the forward end 36 to the rearward end 38 thereof is between 4 to 12 mm, preferably the trimmable rudders 34 are approximately 8 mm long. The width of the trimmable rudders 34 from one side edge 40 to the other side edge 40 is between 2 to 6 mm, preferably the trimmable rudders 34 are approximately 4 mm wide. It is to be appreciated that the dimensions, shape and profile of the trimmable rudders 34 can depend on a desired amount of interface of the trimmable rudder 34 with the airstream, or more simply, the desired amount of deflection on the tail kit base 18 caused by the trimmable rudder 34 when in the extended orientation.

The trimmable rudders 34 are made from a material that is lightweight and resilient such that the trimmable rudders 34 have a minimal effect on the overall weight of the munition 2 and are capable of maintaining their shape and profile when subjected to the stresses placed thereon by the airstream while in their extended orientation. The trimmable rudders 34 can be made from materials including one or more of: aluminum, steel, composites, i.e., carbon fibers, polyetherimide for example. Preferably the trimmable rudders 34 are made from aluminum. These materials can be in the form of thin plates, sheets, injection molded (both composites and metals), stamped films or foils such that the trimmable rudders 34 can be made to have a material thickness of between 0.003 to 0.015 in, preferably the trimmable rudders 34 are made to have a material thickness of approximately 0.010 in. Due to the minimal thickness, weight and rigidity along their length, the trimmable rudders 34 can provide desired aerodynamic characteristics in a minimal amount of space.

Figure 6A:
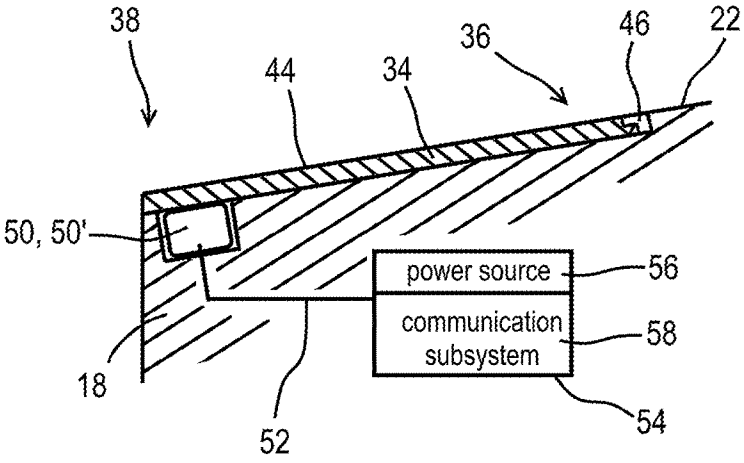
FIGS. 6A and 6B are diagrammatic sectional views showing a portion of a further embodiment of the tail kit assembly according to the disclosure with a trimmable rudder in retracted and extended orientations.
Figure 6B:
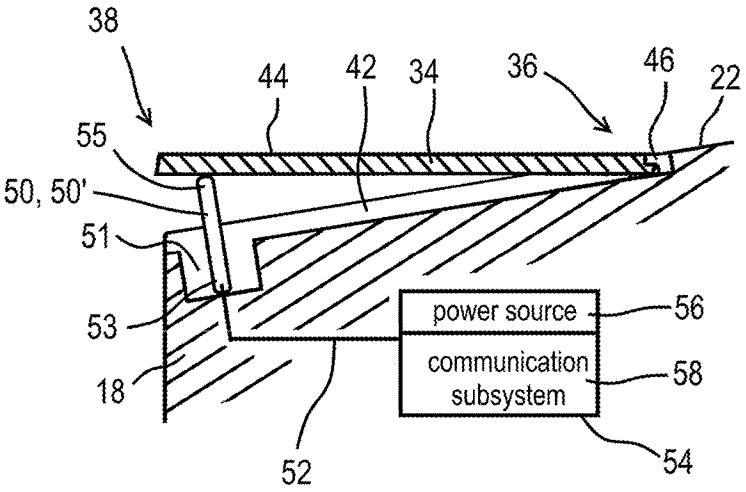

As shown in FIGS. 6A and 6B, the forward end 36 of the trimmable rudder 34 is pivotally connected to the tail kit base 18 by means of a hinge 46 such that the trimmable rudder 34 can biased between the retracted and extended orientations. The hinge 46 is received and fixed within the pocket 42 to the leading end 36 of the trimmable rudder 34.

Figure 7A:
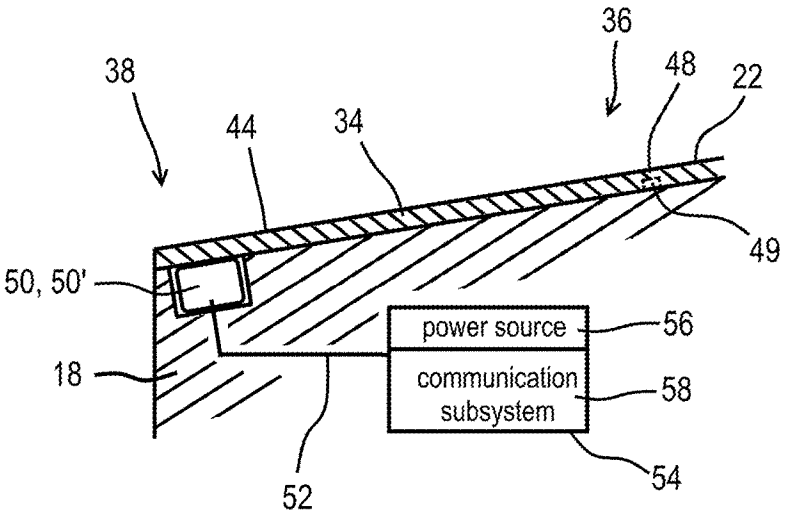
FIGS. 7A and 7B are diagrammatic sectional views a portion of another embodiment of the tail kit assembly according to the disclosure with a trimmable rudder in retracted and extended orientations.
Figure 7B:
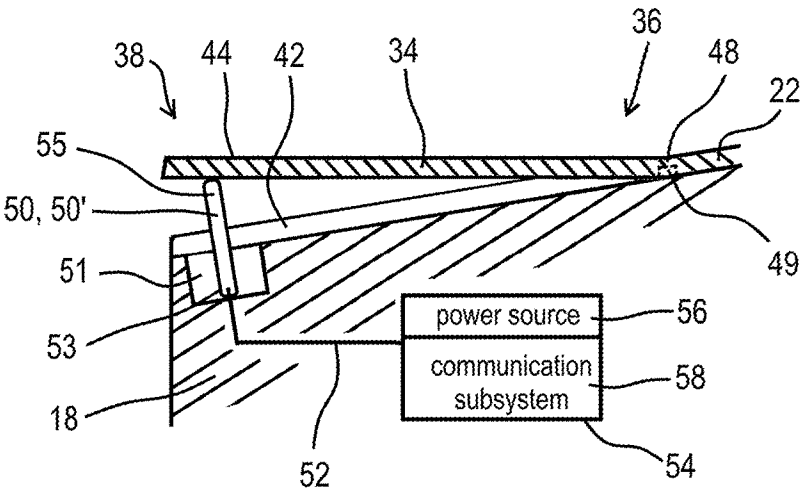

Alternatively, as shown in FIGS. 7A and 7B, the trimmable rudder 34 can be formed as a tab or flap in the outer surface 22 of the tail kit base 18. The rearward end 38 and the two side edges 40 of the trimmable rudder 34 are defined by cuts made in the outer surface 22 of the tail kit base 18. The outer surface 22 of the tail kit base 18 extends into the trimmable rudder 34 which has a flexure point 48 located at the transition from the outer surface 22 to the trimmable rudder 34. Specifically, the flexure point 48 extends between the forward ends of the cuts which define the side edges 40 of the trimmable rudder 34. In an advantageous manner, the outer surface 22 can have a material thickness that is the same as the trimmable rudder 34 and thin enough, i.e., between 0.010 to 0.060 mm, preferably 0.010 mm, to facilitate repeated flexing of the forward end 36 of the trimmable rudder 34. That is to say, the outer surface 22 of the tail kit base 18 has a material thickness that enables the flexure point 48 to be incorporated within the material at the forward end 36 of the trimmable rudder 34. The flexure point 48 enables the trimmable rudder 34 to flex with minimal material resistance when moving between the retracted and extended orientations and without causing the forward end 36 of the trimmable rudder 34 to break off or become disconnected from the outer surface 22 of the tail kit base 18. Alternatively, if the outer surface 22 of the tail kit base 18 has a material thickness that would prevent the forward end 36 of the trimmable rudder 34 from flexing, a shallow notch 49 can be cut into the outer surface 22 at the forward end 36 of the trimmable rudder 34 that enables the trimmable rudder 34 to flex as described.

To bias the trimmable rudder 34 between the retracted and extended orientations, a synthetic muscle 50 is arranged within a cavity 51 in the pocket 42 of the outer surface 22 at the rearward end 38 of the trimmable rudder 34. The inner end 53 of the flexible muscle 50 is secured to the bottom surface of the cavity 51 while the opposite outer end 55 of the flexible muscle 50 is fixed to the inner facing surface of the trimmable rudder 34. The synthetic muscle 50 can be formed, for example, from a polymer or a carbon fiber based material that contracts or expands when a low voltage is applied thereto by the onboard guidance control system 54 via an electrical lead 52. One such synthetic muscle 50 is made from carbon fiber-reinforced siloxane rubber. A synthetic muscle of this type having a 0.4 mm diameter is able to lift 1.89 kg by 1.4 inches with a 0.172 V/cm applied voltage.

It is to be appreciated that in alternate embodiment, the trimmable rudder 34 can be biased between the retracted and extended orientations by means of a piezo actuator 50' that is arranged within the cavity 51 of the pocket 42 at the rearward end 38 of the trimmable rudder 34. The piezo actuator 50' contracts or expands when a voltage is applied by the onboard guidance control system 54 via an electrical lead 52. It is to be appreciated that due to its smaller more compact size, the synthetic muscle 50 is suited for use in smaller munitions, e.g., 25 to 30 mm, and simplifies actuator insertion therein. On the other hand, the piezo actuator 50' is generally larger than the synthetic muscle 50 but it can sustain higher loadings and therefore may be more appropriate for use in the large munitions, e.g., 40 to 57 mm Although the trimmable rudder 34 can be biased by one or the other of the synthetic muscle 50 or the piezo actuator 50', the description below merely refers to the synthetic muscle 50 for biasing the trimmable rudder 34.

As shown in FIG. 2 and FIGS. 6A-7B, the synthetic muscle 50 is arranged in the cavity 51 within the pocket 42 and the inner and outer ends 53, 55 thereof are connected to bottom of the cavity 51 and the rearward end 38 of the trimmable rudder 34, respectively. The synthetic muscle 50 communicates, via the electrical lead 52, with a diagrammatically illustrated an onboard guidance control system 54 including one or more of a power source 56, a communications subsystem 58, MEMS (Micro-Electro-Mechanical-Systems), sensors, components such as a GPS, gyros, accelerometers, and magnetometers as well as optical/RF systems and seekers. It is to be appreciated that in smaller munitions, e.g., 25 to 30 mm, where space is minimal, the onboard guidance control system 54 may only comprise a power source 56 and a communication subsystem 58. In this case, the communication subsystem 58 of the onboard guidance control system 54 receives optical or RF communications from a remote fire control system. Based on the received optical or RF communications, the onboard guidance control system 54 varies the supply of current from the power source 56 to control actuation of the synthetic muscle 50 thereby adjusting the orientation of the trimmable rudder 34 and guiding the munition 2 to the desired target. It is to be appreciated that the power source 56 can be in the form of a battery or similar electric storage unit, or can be an alternator which utilizes the differential rotational speed to generated electrical power.

Figure 8:
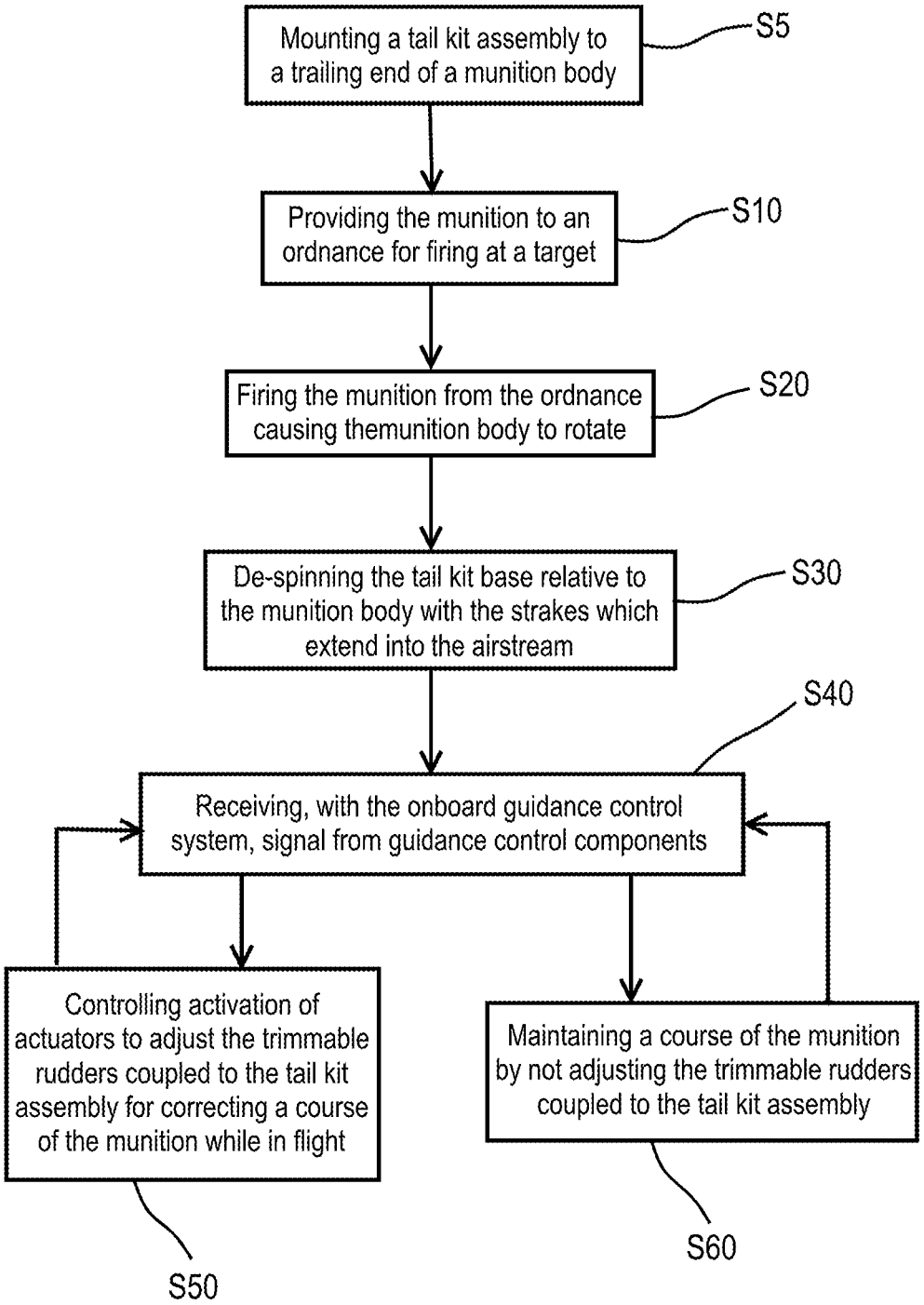
FIG. 8 is a flowchart illustrating a method of trimming a tail kit rudder to guide the trajectory of a munition.

A method of guiding the munition 2 along a trajectory with the trimmable rudders 34 will now be described with reference to the flowchart of FIG. 8. Initially, a tail kit assembly 6 having trimmable rudders 34 and reduced strakes 20 is mounted on the trailing end 14 of the front body 4 of a munition 2 (S5). The munition 2 is then provided (S10) to an ordnance for firing, shooting, or launching at a desired target. Subsequently, the munition 2 is fired from the ordnance by means of a fire control system (S20), which causes the munition 2 to rotate about its longitudinal axis 8, and the strakes 20 to communicate with the airstream either de-spinning (S30) the tail kit base 18 or causing the tail kit base 18 to spin at a rotational speed different than the rotational speed of the front body 4. At about the same time, the guidance control system 54 proceeds to receive (S40) signals, readings, and data from different components thereof and/or from the remote fire control system. The signals, readings, and data can either signify a course correction of the current trajectory or can be analyzed by the guidance control system 54 to determine a course correction of the current trajectory of the munition 2. Based on the received or determined course correction, at any point during the flight of the munition 2, the guidance control system 54 activates and deactivates the synthetic muscles 50 of the one or more trimmable rudders 34 by controlled application (S50) of a voltage to variably adjust an orientation of the one or more trimmable rudders 34 between the retracted and extended orientations to correct the current trajectory of the munition 2. Alternatively, based on the received or determined course correction, the guidance control system 54 may not activate the synthetic muscles 50 so as to maintain (S60) the current trajectory of the munition 2. When no voltage is applied to the synthetic muscle 50, the synthetic muscle 50 is considered to be in its "normal" deactivated state, in which the synthetic muscle 50 is relaxed and fully received within the cavity 51 and the trimmable rudder 34 is situated in its retracted orientation. The guidance control system 54 continually operates to receive and collect readings and data and determine whether or not a course correction of the current trajectory is needed.

When a voltage is applied to the synthetic muscle 50 it can bias the bias the rearward end 38 of the trimmable rudder 34 laterally away from the outer surface 22 of the tail kit base 18 and into the airstream by a distance up to 4 mm, preferably the synthetic muscle 50 biases the trimmable rudder 34 into the airstream approximately 2 mm. It is noted that the distance by which the synthetic muscle 50 biases the trimmable rudder 34 into the airstream can be continuously adjusted based on the amount of voltage applied to the synthetic muscle 50 by the guidance control system 54.

Trimmable tail kit rudders 34 according to the present disclosure are advantageous for a number of reasons. For example, in their retracted orientation, the trimmable rudders 34 are flush with the outer surface 22 of the tail kit base 18 and produce no drag on the munition 2. As a result and in contrast to projectiles having rudders that are fixed in the airstream, the effective range of the munition 2 having trimmable rudders 34 is significantly enhanced.

The trimmable feature of the rudder 34 also enable adapting the orientation of the rudder 34 to the variable air speed (0.5 to 3.0 Mach) and providing the correct amount of rudder trim for the present air speed for the course correction needed.

In addition, although a tail kit assembly 6 having a single trimmable rudder 34 according to the disclosure can be utilized for controlling or guiding the direction of flight F of the munition 2 in an advantageous manner it is recognized that such control is limited, since the single trimmable rudder 34 needs to be properly radially aligned when it is activated in order to deflect the munition 2 in the desired manner. In the case of a single trimmable rudder 34 on the tail kit assembly 6, it is necessary for the tail kit base 18 to rotate about the longitudinal axis 8 so that the radial position of the trimmable rudder 34 can change thus enabling the munition 2 to be deflected in any lateral direction. However, due to rotation of the tail kit base 18, it is necessary for the trimmable rudder 34 to be activated and deactivated rapidly, such that the trimmable rudder 34 is extended only when in the desired radial orientation.

In an advantageous embodiment, the tail kit assembly 6 can have four trimmable rudders 34 that are located at 90 degree intervals from each other about the circumference of the tail kit base 18. A tail kit assembly 6 having four orthogonal trimmable rudders 34 that can be actuated individually or in different combinations to deflect the munition 2 reduces the need for the tail kit base 18 to roll to the correct radial orientation before the trimmable rudder 34 is biased to the extended position. This reduces the amount of time it takes for actuating the trimmable rudders 34 thereby enhancing the responsiveness of the tail kit assembly 6 and making changes in the direction of flight F of the munition 2 more rapid. The synthetic muscles 50 used in certain embodiments of the present disclosure can be deactivated and activated to bias the one or more trimmable rudders 34 between their fully retracted and fully extended orientations at a 200 Hz bandwidth response thus making it possible to leave the tail kit base 18 rotating about the longitudinal axis 8. That is to say, by utilizing the synthetic muscles 50 to rapidly trim the four trimmable rudders 34 it is not necessary to fully eliminate rotation of the tail kit base 18 in order to control or guide the flight of the munition 2. Due to the above, it is possible to reduce the size of the strakes 20 even further so as to have a yet lower interface with the airstream, thereby additionally reducing drag or air resistance caused by the strakes 20 and increasing the effective range of the munition 2. In contrast to strakes of known tail kit assemblies, the strakes 20 of the tail kit assembly 6 according to the disclosure have a reduced/smaller profile. Depending on the actuators 50 employed and the resulting modulation frequencies of the control surface, the strakes 20 according to the disclosure are reduced by more than 3:1 over known strakes. The reduced/smaller strakes 20 of the tail kit assembly 6 reduce the spin of the tail kit base 18 from 20,000 RPM to between 0 to 10,000 or 12,000 RPM and to reduce drag.

The tail kit assembly 6 with the trimmable rudders 34 is capable of generating power, via an alternator, which can be used for powering the onboard guidance control system 54. Using the difference of the rotational speeds (typically 10,000 to 20,000 RPM) of the tail kit assembly 6 and the front body 4, more than ample power, can be generated via a simple alternator, i.e., 100s of watts.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A tail kit assembly, the tail kit assembly comprising:

a tail kit base configured to be connected to a trailing end of a projectile body, the tail kit base being rotatable about a longitudinal axis relative to the projectile body when deployed;

at least one strake being coupled to and radially extending from the tail kit base such that each strake has an edge shaped in a helical manner;

at least one trimmable rudder having forward and rearward ends, the forward end being flexibly coupled to the tail kit base and the rearward end being a rearward free end, such that the at least one trimmable rudder is movable, relative to the tail kit base, between a retracted orientation and an extended orientation; and at least one actuator being fixed between the tail kit base and the rearward free end of each of the at least one trimmable rudder, the at least one actuator configured to be electrically coupled to a guidance system of the projectile body, the guidance system controllably activating each of the at least one actuator to independently bias the rearward free end of the at least one trimmable rudder between the retracted orientation and the extended orientation.

2. The tail kit assembly according to claim 1, wherein the at least one actuator is a synthetic muscle that is electrically activated by the guidance system to bias the corresponding rearward free end of the at least one trimmable rudder to the extended orientation in which the rearward free end of the at least one trimmable rudder is radially biased away from the tail kit base, and, when inactivated, the synthetic muscle is retracted and received within a cavity formed in a lower surface a pocket in the tail kit base and the at least one trimmable rudder is retracted into the pocket in the tail kit base.

3. The tail kit assembly according to claim 2, wherein when each of the at least one trimmable rudders is received within a respective pocket in the surface of the tail kit base, an exterior surface of the trimmable rudder is uniform with an outer surface of the tail kit base.

4. The tail kit assembly according to claim 1, wherein the edge shaped in a helical manner of the at least one strake communicates with an airflow to rotate the tail kit base in a direction counter to a direction of rotation of the projectile body when deployed.

5. The tail kit assembly according to claim 4, wherein the at least one strake reduces drag and provides a differential rotational speed between a rotational speed of the tail kit base and a rotational speed of the projectile body, the differential rotational speed being between 10,000 to 20,000 RPM, and the at least one actuator is configured to be modulated between 50 to 200 Hz to independently actuate the at least one trimmable rudder to facilitate variable course correction matched to a current airspeed of a munition.

6. The tail kit assembly according to claim 4, wherein the at least one strake comprises four orthogonal strakes.

7. The tail kit assembly according to claim 4, wherein the at least one strake is coupled to a separate actuator that adjustably biases the edge of each strake that is shaped in a helical manner into the airstream as a function of air speed to maintain a fixed differential rotational speed between the tail kit base and the projectile body during flight.

8. The tail kit assembly according to claim 1, wherein the at least one trimmable rudder comprises four trimmable rudders and each of the trimmable rudders is configured to be independently biased to the extended orientation during rotation of the tail kit base when each trimmable rudder is oriented in a position correlating to a desired course correction when deployed.

9. The tail kit assembly according to claim 1, wherein the at least one trimmable rudder comprises a plurality of trimmable rudders and each of the plurality of trimmable rudders is configured to be controllably biased independent of each other by a corresponding one of a plurality of actuators.

10. The tail kit assembly according to claim 9, wherein each of the plurality of actuators being synthetic muscle that when deactivated and activated is configured to bias the corresponding rearward free end of a trimmable rudder between the retracted and the extended orientations at a frequency of 200 Hz.

11. The tail kit assembly according to claim 1, further comprising a plurality of strakes being connected to the tail kit base, the plurality of strakes reduce the spin of the tail kit base from 20,000 RPM to between 0 to 12,000 RPM when deployed.

12. The tail kit assembly according to claim 11, wherein the at least one trimmable rudder, in the retracted orientation, is configured to be received in the tail kit base such that an exterior surface of the at least one trimmable rudder is entirely flush with an outer surface of the tail kit base, and the plurality of strakes are coupled to at least one actuator that variably biases an edge of each of the plurality of strakes that is shaped in a helical manner into the airstream such that an interaction of the strake with the airstream is adjustable.

13. The tail kit assembly according to claim 12, wherein the plurality of strakes is variably biased into the airstream as a function of airspeed of the munition such that a fixed differential rotational speed between the tail kit base and the projectile body is maintained during flight.

14. The tail kit assembly according to claim 1, wherein each of the at least one trimmable rudders is formed as a hinged flap in an outer surface of the tail kit base.

15. The tail kit assembly according to claim 14, wherein the at least one trimmable rudder comprises four hinged flaps, each of the four hinged flaps being independently moved by a corresponding actuator to the extended orientation during rotation of the tail kit base when that flap is aligned in a position correlating to a desired course correction of the munition.

16. The tail kit assembly according to claim 2, wherein the synthetic muscle is comprised of a carbon fiber material.

17. A method of guiding a munition having a tail kit assembly, the method comprising:

mounting at least one trimmable rudder and at least one strake having an edge shaped in a helical manner on the tail kit assembly;

providing the munition to an ordnance and firing the munition such that a body of the munition rotates about a longitudinal axis at a first rotational speed;

de-spinning the tail kit assembly with the at least one strake such that the tail kit assembly rotates about the longitudinal axis at a second rotational speed relative to the munition body;

receiving, with a guidance control system, signals which either signify a course correction of a current trajectory of the munition is necessary or unnecessary;

if the received signals signify the course correction is necessary, controlling an actuator per each at least one trimmable rudder, with the guidance control system, to adjust an orientation of a rearward free end of the at least one trimmable rudder between a retracted orientation and an extended orientation to correct the current trajectory of the munition; and if the received signals signify a course correction is unnecessary, maintaining, with the guidance control system, the orientation of the at least one trimmable rudder between the retracted orientation and the extended orientation to maintain the current trajectory of the munition.

18. The method of guiding a munition according to claim 17, further comprising:

de-spinning the tail kit assembly with the at least one strake, to cause rotation counter to the rotation of the body of the munition and providing a differential rotational speed from 10,000 to 20,000 RPM to reduce drag.

19. A tail kit assembly for a projectile, the tail kit assembly comprising:

a tail kit base configured to be connected to a trailing end of a projectile body, the tail kit base being rotatable about a longitudinal axis relative to the projectile body when deployed;

at least one strake coupled to and radially extending from the tail kit base such that each strake has an edge shaped in a helical manner;

at least one trimmable rudder having forward and rearward ends, the forward end being flexibly coupled to the tail kit base and the rearward end being a rearward free end, such that the at least one trimmable rudder is movable, relative to the tail kit base, between a retracted orientation and an extended orientation; and at least one actuator being fixed between the tail kit base and the rearward free end of each of the at least one trimmable rudder, the at least one actuator configured to be electrically coupled to a guidance system of the projectile body, the guidance system controllably activating each of the at least one actuator to independently bias the rearward free end of the at least one trimmable rudder between the retracted orientation and the extended orientation, wherein the at least one actuator is a synthetic muscle that is electrically activated by the guidance system to bias the corresponding rearward free end of the at least one trimmable rudder to the extended orientation in which the rearward free end of the at least one trimmable rudder is radially biased away from the tail kit base, and, when inactivated, the synthetic muscle is retracted and received within a cavity formed in a lower surface a pocket in the tail kit base and the at least one trimmable rudder is retracted into the pocket in the tail kit base.

* * * * *